United States Patent [19]

Rager

[11] 4,335,816

[45] Jun. 22, 1982

[54] LATCH ASSEMBLY FOR DISK PACK HANDLE AND THE LIKE

[76] Inventor: Edgar A. Rager, 601 Almarida Dr., Apt. T6, Campbell, Calif. 95008

[21] Appl. No.: 165,290

[22] Filed: Jul. 2, 1980

[51] Int. Cl.[3] ..... B65D 85/30

[52] U.S. Cl. ..... 206/444; 206/1.5; 292/39; 292/160

[58] Field of Search ..... 292/39, 41, 22, 160, 292/279; 206/444, 1.5; 220/314, 324, 318, 323

[56] References Cited

U.S. PATENT DOCUMENTS 3,882,701 5/1975 Wirth ..... 206/444

4,090,609 5/1978 Rager ..... 206/444

FOREIGN PATENT DOCUMENTS 503995 12/1954 Italy ..... 292/39

*Primary Examiner*—Joseph Man-Fu Moy

*Attorney, Agent, or Firm*—Thomas Schneck

[57] ABSTRACT

A latch assembly wherein an elongated latch housing can be selectively locked opposite arms of a C-shaped handle. A slider button movable on the housing exterior, along the length of the housing, by racks and a pinion gear to two dogs also movable along the length of the housing, but interiorly to the housing. By pushing the slider on the housing, the dogs are forced outwardly relative to the housing, so that the housing is locked to the handle.

10 Claims, 15 Drawing Figures

LATCH ASSEMBLY FOR DISK PACK HANDLE AND THE LIKE

BACKGROUND OF THE INVENTION a. Field of the Invention

The invention pertains generally to latching assemblies and in particular to latching assemblies for a disk pack handle or the like.

b. Prior Art

In U.S. Pat. No. 4,090,609 E. Rager discloses three functions which are performed by a handle for a disk pack. First, the handle should lay flat on the cover of a disk pack for compact storage. Second, the handle may be used to pick up a disk pack. Third, when a latch is activated, the handle may be used to separate the cover of the pack from the remainder of the container, so that a disk connected to the cover may be inserted in a disk drive or a computer.

At least two types of latching assemblies are known in the prior art. One type is disclosed in the previously mentioned U.S. Pat. No. 4,090,609. In this latching assembly, a latch housing is provided which resides between opposite sides of a U-shaped disk pack handle. The housing has a sliding button which moves transverse to the lengthwise dimension of the housing and nudges two movable dogs outwardly latching the housing to the handle. Two nested pivots in pivot sockets within the housing are then raised when the handle is raised, providing leverage for separating a disk pack cover and a connected disk from a disk container.

Another type of latching assembly is shown in U.S. Pat. No. 3,882,701 to W. Wirth. In this patent a slider button is provided which moves along the length of the latch housing in order to lock an interior pivoting metal member in place so that lifting of the cover of the disk pack may be achieved. In the Wirth device, the latch housing is stationary relative to the handle. This is in contrast to the prior Rager device wherein the latch is secured to the handle only during the separation of a disk pack cover from the contents. The advantage of the prior Rager device is that it is relatively simple. On the other hand, one of the advantages of the Wirth device is that the direction of motion of the slider button is universally recognized in the computer industry.

An object of the present invention was to devise a latch assembly in which the slider motion was parallel to the elongated dimension of the latch housing in accord with customary practice within the industry, yet which is economical to construct and which provides good disk separation from a container.

SUMMARY OF THE INVENTION

The above object has been achieved with a latch assembly having an elongate housing containing a single pinion gear for driving two sets of racks outwardly, which causes a latch housing to lock onto a disk pack handle. As a handle on a disk cover is raised, pivots internal to the housing raise tabs which cause separation of a disk and its cover from the disk container. A first rack is connected to a slider button which moves parallel to the elongate dimension of the housing. A pair of opposed movable dogs, each of which is also parallel to the elongate dimension of the housing, is driven outwardly by a second rack, also connected to the pinion gear, into opposed arms of the handle for locking the housing to the handle.

Linear motion of the slider button is translated to pinion gear rotary motion by the first rack. In turn, the pinion gear converts rotary motion back to linear motion for driving the dogs outwardly, locking the latch housing to the handle. A spring biases the dogs inwardly so that locking between the housing and handle occurs only when the spring bias is overcome.

DESCRIPTION OF THE PREFERRED EMBODIMENT

Figure 1:
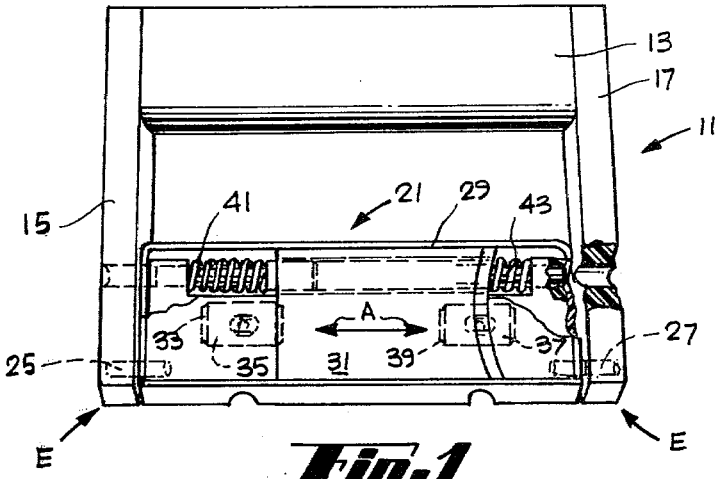
FIG. 1 is a top perspective view of a latch assembly of the present invention shown in an unlocked position relative to a connected handle.

With reference to FIG. 1, a prior art C-shaped disk pack handle 11 is shown having a gripping portion 13 which is normally grasped in one hand of a user and two opposed arms 15, 17 which are connected to the cover of the disk pack by means of pins, not shown, near the ends, E, of the arms.

The latch assembly of the present invention has an elongated dimension, in the direction indicated by the arrow A. That dimension is such that the housing member 21 fits between arms 15 and 17. Housing member 21 is connected to the arms 15 and 17 by means of hinge pins 25 and 27. The exterior of housing 21 has an upper peripheral wall 29 which confines the motion of a movable slider button 31. The slider button moves from the central region of the top of housing 21, as shown in FIG. 1, toward the hinge pin 25. A pair of pivot sockets 33, 39 may be seen in the interior of the housing for holding the nested pivots 35, 37 respectively. The construction of these pivots and their pivot sockets is described in the aforementioned U.S. Pat. No. 4,090,609.

Within the interior of the housing 21 are two opposed movable dogs 41, 43 which are driven laterally within a channel in the housing and through holes in the wall of the housing into the handle arms 15, 17. When the housing is flat between the handle arms and the dogs are pushed outwardly, the dogs lock the housing 31 to handle 11, as in the previously mentioned patent to Rager. The slider 31 communicates force to the dogs, as explained below.

Figure 2:
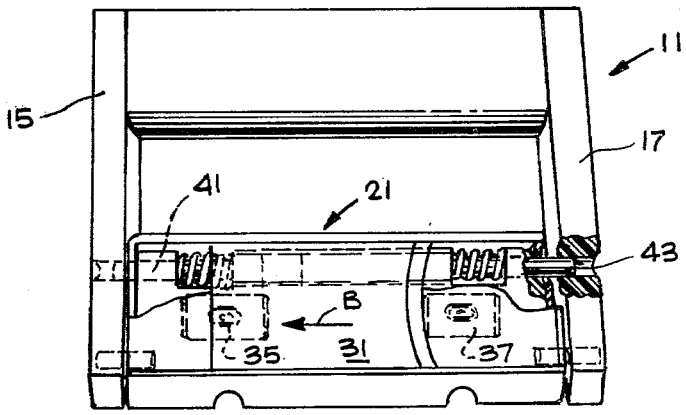
FIG. 2 shows the latch assembly of FIG. 1 in a locked position.

FIG. 2 shows one of the two dogs 43 projecting into arm 17 with the slider 31 having moved in the direction indicated by the arrow B. Although not shown, dog 41 is projecting into arm 15. In this position, the housing 21 is locked to handle 11. This enables pivots 35 and 37 to move upwardly for cover separation, with an attached disk, from a disk container.

Figure 3:
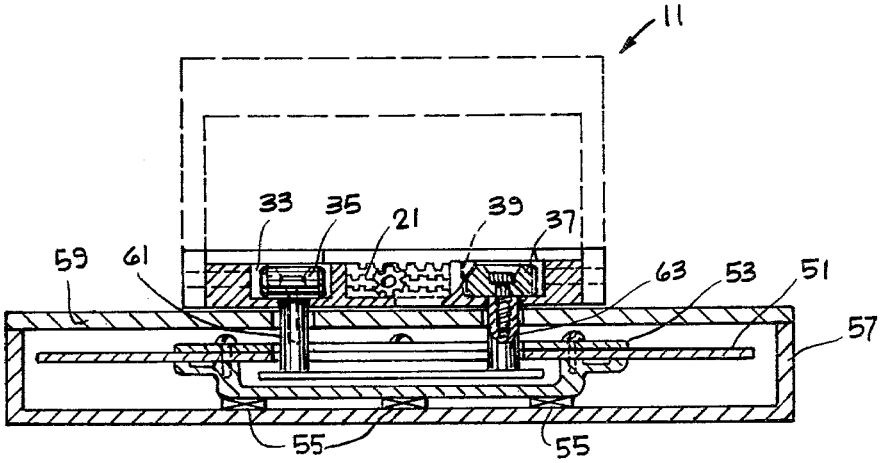
FIG. 3 shows the latch assembly of the present invention relative to a complete disk pack, including a disk, its container and cover, with the cover having a handle to which the latch assembly is connected.

The overall relation of the latch assembly of the present invention to a disk pack and its container may be seen relative to FIG. 3. In that Figure, a magnetic disk 51 may be seen to be mounted on a metallic carrier 53. Normally, this carrier is ferromagnetic so that it can be held down by magnets 55 which are connected to the interior of the bottom wall of the cylindrical container 57. The container 57 has a removable cover 59 through which the lifting tabs 61, 63 communicate with carrier 53. Each of the lifting tabs terminates upwardly in a respective pivot 35, 37 nesting in a pivot socket 33, 39. These sockets are within the interior of housing 21. When upward force is applied to tabs 61 and 63 the force holding the holder 53 to the magnets 55 may be overcome. In order for this to happen, the pivots 35, 37 must be raised while container 57 and its cover 59 remain in place. This is achieved by latching housing 21 to the handle 11 so that when the handle is raised in the position indicated by the phantom lines in FIG. 3 the socket pins 65, 67 will be raised, while container 57 and its cover remain stationary. Disk carrier 53 becomes separated from the magnets 55 so that the cover may be lifted when an upward lifting force is applied to the handle 11, as described in the previously mentioned patent to Rager.

Figure 4:
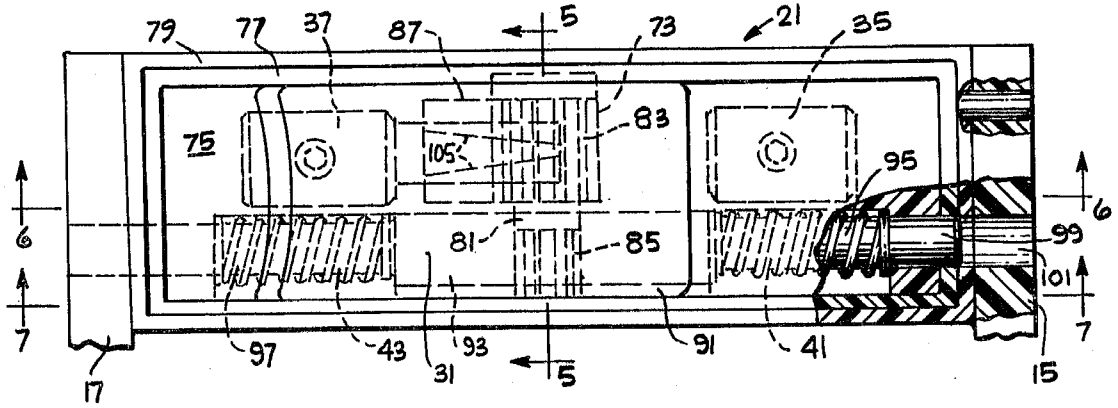
FIG. 4 is a top cutaway view of the latch assembly of the present invention with interior parts indicated by phantom lines.

With reference to FIG. 4 some of the details for enabling the movable slider 31 to communicate force to the dogs 41, 43 may be seen. The slider 31 transmits force through a hole, indicated by dashed line 73 in the cover 75 of the housing 21. This cover 75 supports the slider button 31 and has the inner wall 77 which confines the motion of button 73. The outer wall 79 for the housing 21 has a slightly greater perimeter than the inner wall 77 for allowing the latter to be mounted therein as a unit with the slider 31. The two walls 77, 79 form the wall 29 of FIG. 1.

Slider 31 communicates with a pinion gear 81 which has a large diameter portion 83 and an integral small diameter portion 85 in axial alignment therewith. The pinion gear 81 is mounted for rotation along an axis perpendicular to the direction of motion of the slider 31. The slider 31 carries a first rack indicated by the dashed line 87. This first rack has teeth for meshing with the large diameter portion 83 of the pinion gear 81. The pinion gear 81 is mounted so that linear motion of slider 31 is translated into rotary pinion gear motion. This rotary motion is transferred to second racks 91, 93 which form inner end portions of the respective dogs 41, 43. These dogs also have outer end portions 95, 97 which extend into respective arms of the handle. For example, the outer end portion 95 of dog 41 is cylindrical and fits into the cylindrical bore 99 through the wall of housing 21 for projection into an aligned bore 101 in handle arm 15. Corresponding bores exist in arm 17 and the opposite portion of the housing 21 for the benefit of enabling outer end portion 97 of dog 43 to reach arm 17.

Figure 5:
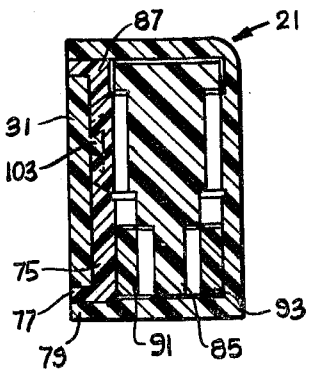
FIG. 5 is a side sectional view of the latch assembly of the present invention taken along lines 5—5 of FIG. 4.

The side cutaway view of FIG. 5 shows that slider 31 is connected to the first rack 87 by means of an interlocking connection 103. Returning momentarily to FIG. 4, the shape of the interlocking connection is shown to be tapered, as indicated by the dashed lines 105. This taper precludes errors in assembly when connecting the slider 31 to rack 87. It also provides for a proper fit between the two pieces, placing the slider at the desired position relative to rack 103. The rack 103 may be seen to be contacting the large diameter portion 83 of the pinion gear, while the second racks 91, 93 have teeth contacting the smaller pinion gear portion 85. The housing 21 may be seen to have a U-shaped outer wall 79 within which the periphery of inner wall 77 snugly fits. The outer wall 77 defines the outside rim of housing cover 75.

Figure 6:
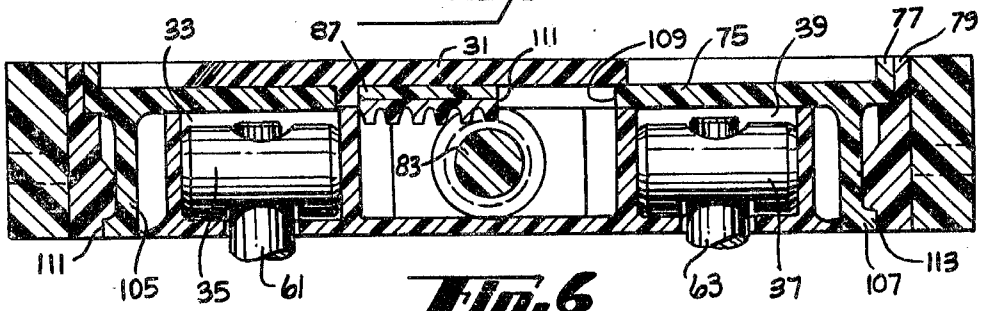
FIG. 6 is a longitudinal sectional view of the latch assembly of the present invention taken along lines 6—6 of FIG. 4.

With reference to FIG. 6, the pivots 35, 37 which support the respective tabs 61, 63 may be seen to be housed in respective pivot sockets 33, 39 with clearance relative to the first rack 87. The slider 31 may push rack 87 as far as the abutting wall 109 of cover 75 where the leading edge 111 of rack 87 would be stopped. The large diameter portion 83 of the pinion gear preferably has a circular complement of teeth which mesh with the teeth of rack 87, although all of the gear teeth are not shown in the figure.

Note that the cover 75 of the housing member has two downwardly extending legs 105, 107. The bottom portions of these legs taper outwardly and fit into corresponding indentations 111, 113 within the bottom of the interior wall of the housing. Thus, once the cover 75 of the housing is pushed into place, it will remain in place.

Figure 7:
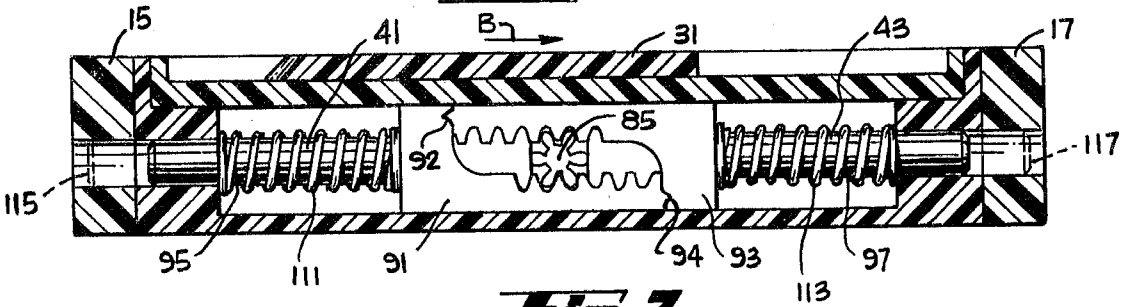
FIG. 7 is another longitudinal sectional view of the latch assembly of the present invention taken along lines 7—7 of FIG. 4.

In the cutaway of FIG. 7, the small diameter pinion portion 85 may be seen to be in contact with second racks 91, 93 of respective dogs 41, 43. The dogs also contact each other at nose regions 92, 94 for mutually stopping inward motion. The respective outer ends 95, 97 of the dogs are surrounded by spiral springs 111, 113 respectively which bias the dogs inwardly. This bias must be overcome by pushing the slider 31 into the direction indicated by the arrow B. The outer ends 95, 97 will advance as far as the positions indicated by the dashed lines 115, 117 in arms 15, 17 respectively. Recall that the abutting wall 109 will stop the first rack 87 after a predetermined amount of slider travel. This same amount of slider travel limits the outward travel of the racks 91 and 93.

Figure 8:
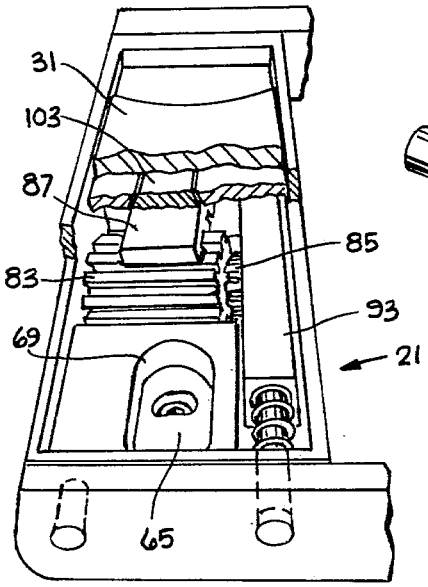
FIG. 8 is an end, partially cutaway, perspective view of the latch assembly of FIG. 4.

FIG. 8 shows the relative relation of a pivot 65 within a respective pivot socket 69 defined within the interior of housing 21. The large diameter pinion portion 83 is shown to be in rotational alignment with the smaller diameter pinion portion 85. The large diameter portion 83 is driven by the first rack 87 which communicates with slider 31 by means of the interlocking connection 103. Once rotational force is transmitted to the first pinion gear portion 83, the smaller diameter portion 85 will simultaneously rotate, transmitting force to the second rack 93.

Figure 9:
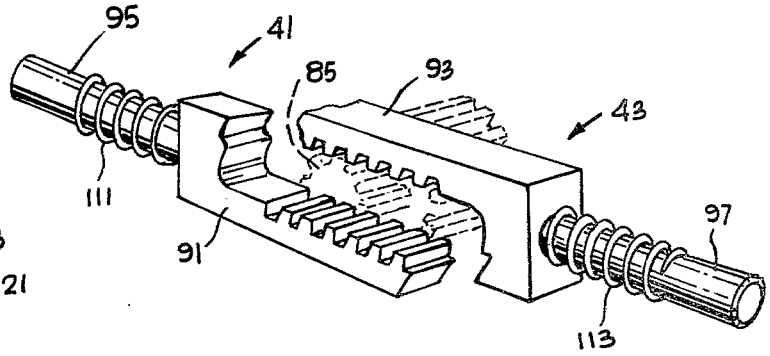
FIG. 9 is a detail, perspective view showing opposed dogs in relation to a pinion gear, all for mounting within the housing of the latch assembly illustrated in FIG. 8.

With reference to FIG. 9, the first and second dogs 41, 43 may be seen to each be unitary members. The dog 41 has an outer cylindrical end portion 95 and an inner end portion 91 defining a second rack. Similarly, the dog 43 has the outer cylindrical end portion 97 and the inner end portion 93, also defining a second rack, both of the second racks having teeth which mesh with the smaller pinion gear portion 85.

Figure 10:
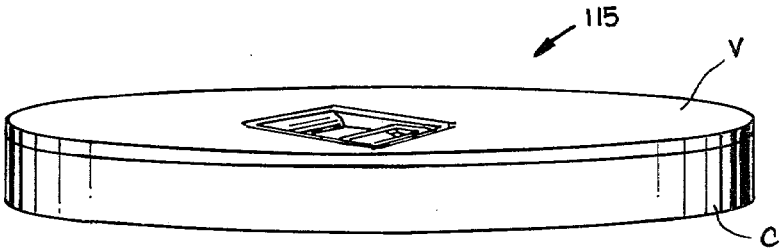
FIG. 10 is a perspective view of the exterior of a disk pack container and cover in a storage position.
Figure 11:
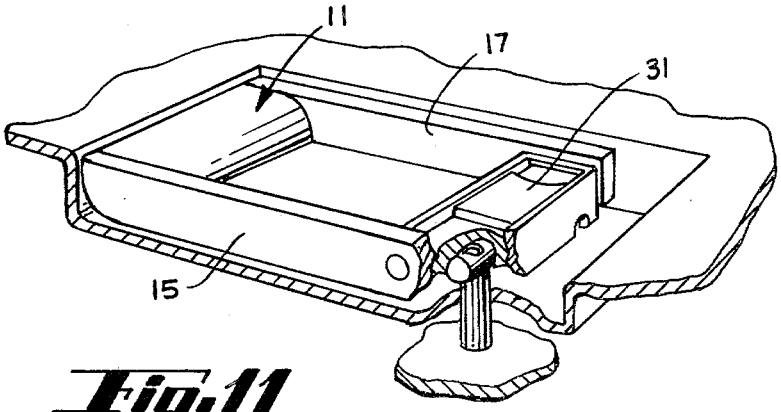
FIG. 11 is a perspective detail view of a portion of a disk pack cover having a handle with the latch assembly of the present invention in a storage position, as in FIG. 10.
Figure 12:
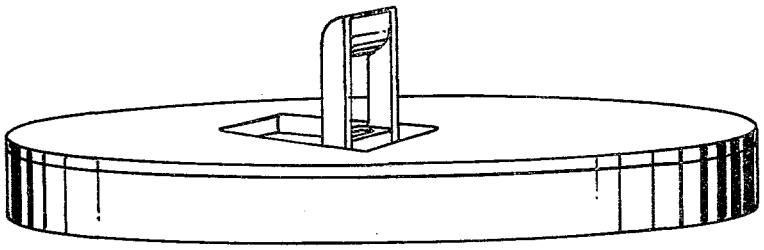
FIG. 12 is a perspective view of the exterior of the disk pack container and cover of FIG. 10 with the disk pack handle and container in a carry position.
Figure 13:
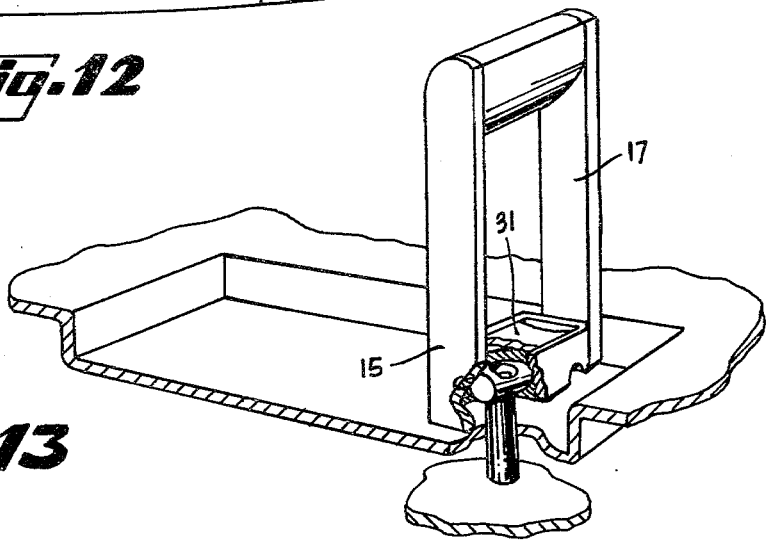
FIG. 13 is a perspective detail view of the handle with the latch assembly of the present invention in a carry position, as in FIG. 12.

FIG. 10 shows a disk pack 115 with a cover V and a container C in a storage configuration. In FIG. 11, the handle 11 is shown with slider 31 in a central position so that the dogs do not project into the arms 15, 17 of the handle. In this configuration, the handle may be raised and the entire disk pack picked up or the handle may be lowered, as shown, for storage. In FIG. 12, the handle is shown raised in the "carry" position. In FIG. 13, the slider 31 is still shown to be in a central position with the dogs not entering the opposed arms 15, 17 of the handle, so that the handle can be raised without cover separation.

Figure 14:
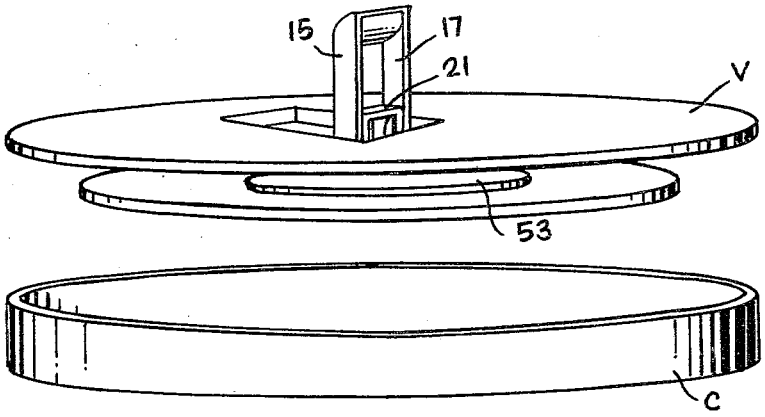
FIG. 14 is a perspective view of the exterior of the disk pack container and cover of FIG. 10 with the disk pack handle in a separation position.
Figure 15:
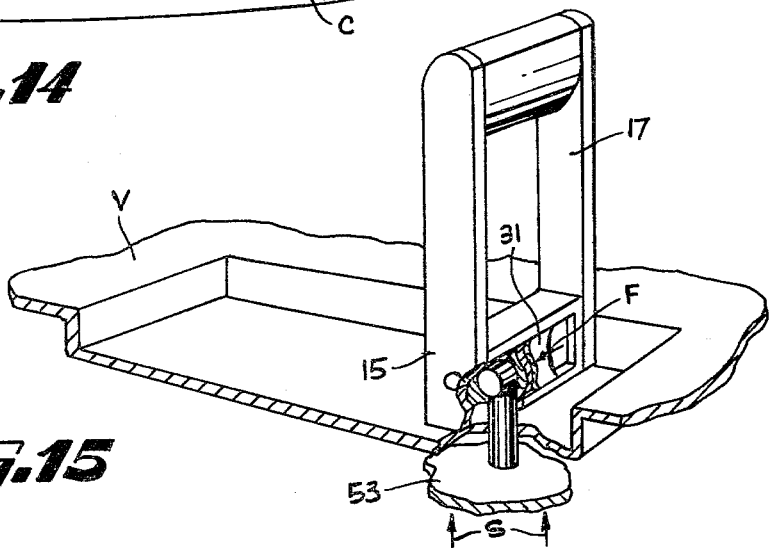
FIG. 15 is a perspective detail view of the handle with the latch assembly of the present invention in a separation position, as in FIG. 14.

In FIG. 14, the handle is shown in the "release" position with the housing 21 shown to have been latched to the arms 15 and 17 so that it is turned on its side. This rotation of the housing causes a raising of the pivots within the housing, which in turn raise connected tabs causing a separation of the disk holder 53 from magnets holding it down. This separation is indicated by the arrows S. The dogs are projecting into the arms 15, 17 as force is applied to slider 31 in the direction indicated by the arrow F. Normally, this force is applied by the thumb of one hand pushing the slider button indicated by the arrow, while the other hand grasps the top of the handle and lifts the disk cover V upwardly separating the disk holder and cover from a container.

The entire latch assembly, except for the spiral springs, and the outer ends of the dogs, may be made of a plastic material such as Delrin, although other plastics or metal material may be used. The advantage of using Delrin is that it is easily molded and has high strength properties. The outer end portions 95, 97 of the dogs 41, 43 may be metal cylinders which have enlarged ends about which the inner end portions 91, 93 are molded, such that each dog is unitary. Alternatively, the inward and outward portions could be fastened together by screwing or bonding.

The use of the present invention with disk packs is only exemplary. The apparatus may be used with a handle for other releasable covers which are to be latched to containers in a selectable manner.

What is claimed is:

1. A latch assembly for a handle used on a disk pack or similar article comprising, an elongate housing rotatably hinged between opposed arms of a handle, said housing having a movable slider exteriorly mounted thereon for motion parallel to the elongate dimension of said housing, a pair of opposed movable dogs mounted in a channel in said housing for slidable motion therein in opposite directions, parallel to the direction of motion of the slider, said channel terminating in opposed apertures in said housing communicating with similar apertures in opposite arms of a handle, and rack and pinion means connected to said slider and to said dogs for urging said dogs outwardly into said apertures thereby locking said housing to said handle.

2. The latch assembly of claim 1 wherein said slider is connected to a first rack and each of said movable dogs comprises an inner end having a second rack, the first and second racks being driven by a pinion gear.

3. The latch assembly of claim 2 wherein said pinion gear has one diameter for meshing with said first rack and another diameter for meshing with said second rack.

4. The latch assembly of claim 2 wherein one of said dogs has a second rack in contact with an upper side of said pinion gear and another of said dogs has a second rack in contact with a lower side of said pinion gear.

5. A latch assembly for a handle used on a disk pack or similar article comprising an elongate housing rotatably hinged between opposed arms of a handle, said housing having a movable slider exteriorly mounted thereon for motion parallel to the elongate dimension of said housing and a first rack mounted in the interior of said housing and connected to said slider, a pinion gear mounted within said housing in rack and pinion rotational relation with said first rack, and a pair of opposed movable dogs, each dog mounted in a channel for slidable motion therein in opposite directions, parallel to the direction of motion of the slider, each dog having an outer end portion of a size for passing outwardly through a corresponding opening in said housing and into a similar opening defined in a connected handle, each dog also having an inner end portion connected to the outer end portion, said inner end portion having a second rack meshing with said pinion gear, whereby slider motion may drive said dogs outwardly locking said housing to a connected handle.

6. The latch assembly of claim 5 wherein said pinion gear has a large diameter portion for meshing with said first rack and a lesser diameter portion for meshing with said second rack.

7. The latch assembly of claim 5 further defined by spring means communicating with said dogs and the slider for biasing said dogs inwardly relative to the housing, whereby said bias must be overcome by force on the slider for pushing said dogs outwardly of said housing for latching the housing to a connected handle.

8. The latch assembly of claim 7 wherein said spring means comprises a spiral spring mounted over the outer end portion of each dog.

9. The latch assembly of claim 5 wherein the inner end portion of each dog comprises an elongated member having a sled-like side for slidable motion in said channel and said second rack on a side opposite said sled-like side.

10. The latch assembly of claim 5 wherein said slider has an interlocking connection with said first rack.

* * * * *